United States Patent [19]

Retzloff et al.

[11] Patent Number: 4,570,720

[45] Date of Patent: Feb. 18, 1986

[54] SPRINKLER HEAD

[75] Inventors: James G. Retzloff, Lansing; Gerald W. Sanders, Hastings, both of Mich.

[73] Assignee: The Viking Corporation, Hastings, Mich.

[21] Appl. No.: 170,049

[22] Filed: Jul. 18, 1980

[51] Int. Cl.[4] ..... A62C 37/08

[52] U.S. Cl. ..... 169/39; 169/40

[58] Field of Search ..... 169/38, 39, 40, 41, 169/37, 57

[56] References Cited

U.S. PATENT DOCUMENTS

| | | | |
|---|---|---|---|
| 1,919,235 | 7/1933 | Loepsinger | 169/39 |
| 2,004,833 | 6/1935 | Rowley | 169/38 |
| 2,664,956 | 1/1954 | Barz | 169/38 |
| 2,697,008 | 12/1954 | Rowley | 169/39 |
| 2,724,614 | 11/1955 | Rider | 169/39 |
| 4,136,740 | 1/1979 | Groos et al. | 169/39 |
| 4,167,974 | 9/1979 | Job | 169/38 |

FOREIGN PATENT DOCUMENTS

| | | | |
|---|---|---|---|
| 765125 | 1/1957 | United Kingdom | 109/37 |

OTHER PUBLICATIONS

"Viking Sprinkler System Guide"; from the Viking Corp.; Sep. 1978, pp. 18–21.

*Primary Examiner*—Joseph J. Rolla
*Assistant Examiner*—Kenneth Noland
*Attorney, Agent, or Firm*—Price, Heneveld, Huizenga & Cooper

[57] ABSTRACT

A sprinkler head includes a nozzle, a frame and a rigid mechanical fusible link assembly positioned between the frame and a closure plug or cap. An annular, normally concave spring is disposed between the cap and the nozzle. The spring creates a force which throws the link assembly clear of the head upon actuation.

1 Claim, 3 Drawing Figures

SPRINKLER HEAD

BACKGROUND OF THE INVENTION

This invention relates to fire protection systems and more particularly to an improved sprinkler head for use in automatic sprinkler systems.

Automatic sprinkler systems are presently considered the mose dependable and effective means of fire protection. Sprinkler systems are available in basically five types. Wet pipe systems employ automatic sprinkler heads attached to piping containing water which is at all times under pressure. Upon the occurrence of a fire, individual sprinkler heads are actuated by the heat. Upon actuation, the sprinkler head nozzle is opened and water is discharged.

Dry pipe systems also employ automatic sprinkler heads which are, however, attached to piping containing air under pressure. When the sprinkler head is actuated by the heat from a fire, the air pressure is reduced and the dry pipe valve is opened by water pressure, resulting in discharge of water through the open sprinklers.

Preaction systems are also available which are actuated by heat sensitive devices or automatic fire detection systems. Such devices or systems trip a controlling valve and permit water to enter the otherwise dry sprinkler piping before the automatic sprinkler heads are actuated.

Deluge systems are available which function to deliver the most water in the least amount of time. Such systems wet down an entire fire area by admitting water to sprinklers, sprinkler heads or spray nozzles that are open at all times.

Finally, fire cycle systems are available which initially duplicate conventional preaction systems. Such fire cycle systems, however, have the additional ability to cycle on and off while controlling a fire and to shut themselves off automatically when the fire is extinguished.

Heretofore, a large variety of automatic sprinkler heads have been proposed for use in the various sprinkler systems. Typically, the sprinkler heads include a body defining a nozzle and a frame having a pair of arms which extend from the nozzle and are joined at a frusto-conical portion opposite the nozzle. Usually, some form of distributor or deflector plate is attached to the frame to prevent upward spray of liquid issuing from the nozzle and/or to insure proper distribution of the water or other fire control liquid. A thermally responsive actuator is positioned between the frusto-conical portion and a cap or valve element disposed within the nozzle. Upon attainment of a predetermined ambient temperature range, the thermally responsive element is triggered or actuated permitting release of the cap or valve element from the nozzle.

The various standards for sprinkler heads require that the head create a force which will throw the actuator clear of the head. Heretofore, this force has been created by the arms of the frame. Examples of such prior sprinklers may be found in U.S. Pat. No. 2,664,956, entitled Sprinkler Head, issued on Jan. 5, 1954, to Barz; U.S. Pat. No. 2,697,008, entitled Sprinkler Head and issued on Dec. 14, 1954, to Rowley; U.S. Pat. No. 2,724,614, entitled Spray Sprinkler and issued on Nov. 22, 1955, to Rider; and commonly owned U.S. Pat. No. 4,136,740, entitled Large Drop Sprinkler Head for High Heat Output Fires and issued on Jan. 30, 1979, to Groos et al.

The sprinkler heads disclosed in the aforementioned patents employ rigid, fusible links positioned between the valve cap element and the joined end of the arms of the frame. With these types of heads, the spring action or spring pressure created by the frame is employed to throw the link assembly free of the head upon fusion of the fusible material joining the link assembly together. For example, in the aforementioned U.S. Pat. No. 4,136,740, a sprinkler head is disclosed which includes a cap or valve element held in place by two opposing lever arms which are in turn held together by a ball bearing fusible link. The fusible link employs a eutectic solder to hold the link elements together. Upon attainment of a predetermined ambient temperature range, the solder in the link fuses. The links will then separate on the free rolling ball bearings. The lever arms, which have an offset center, are thrown clear of the head by the spring pressure of the frame. The cap or valve element is thrown out and clear of the head by water pressure.

Sprinkler heads are also available which do not employ a rigid mechanical fusible link assembly for actuation. An example of one such head is disclosed in U.S. Pat. No. 4,167,974, entitled Sprinkler and issued on Sept. 18, 1979, to Job. The sprinkler disclosed in this patent includes a glass bulb actuator positioned between the joined ends of the arms of the frame and the cap or valve element. When the predetermined temperature range is reached, the fluid contained within the glass bulb expands in volume, bursts the glass and thereby throws the glass pieces free of the sprinkler head. As a result, spring pressure created by the arms is not necessary to achieve throw out of the thermally responsive element.

SUMMARY OF THE INVENTION

Significant cost savings would be experienced if a sprinkler head could be constructed which did not employ the spring force created by the arms to achieve the trigger throw out and which would not require a glass bulb type thermal responsive actuator or element. A need, therefore, exists for such an improved automatic sprinkler head.

In accordance with the present invention, a unique automatic sprinkler head is provided whereby the aforementioned need is achieved. Essentially, the head includes a nozzle, an essentially unstressed frame defined by a pair of arms which are joined opposite the nozzle, a closure cap or plug disposed within the nozzle and a rigid, mechanical fusible link assembly positioned between the frame and the cap. Resilient means, disposed between the nozzle and the cap, create a force which will throw the link assembly away from the sprinkler head when a predetermined temperature range is reached.

In narrower aspects of the invention, the resilient means is an annular, generally concave spring member having a peripheral edge engaging the nozzle and a central aperture within which the closure cap is disposed.

The unique sprinkler head in accordance with the present invention results in a significant reduction in cost of manufacture and assembly. Since the throw out force is created by the resilient means disposed between the cap and the fusible link assembly, the arms of the sprinkler head frame are essentially unstressed. Criticality in the pressure or force created by the arms is therefore removed. This reduces problems heretofore experienced in the manufacture and assembly of sprinkler heads employing mechanical, rigid fusible link assemblies.

DETAILED DESCRIPTION OF THE PREFERRED EMBODIMENT

Figure 1:
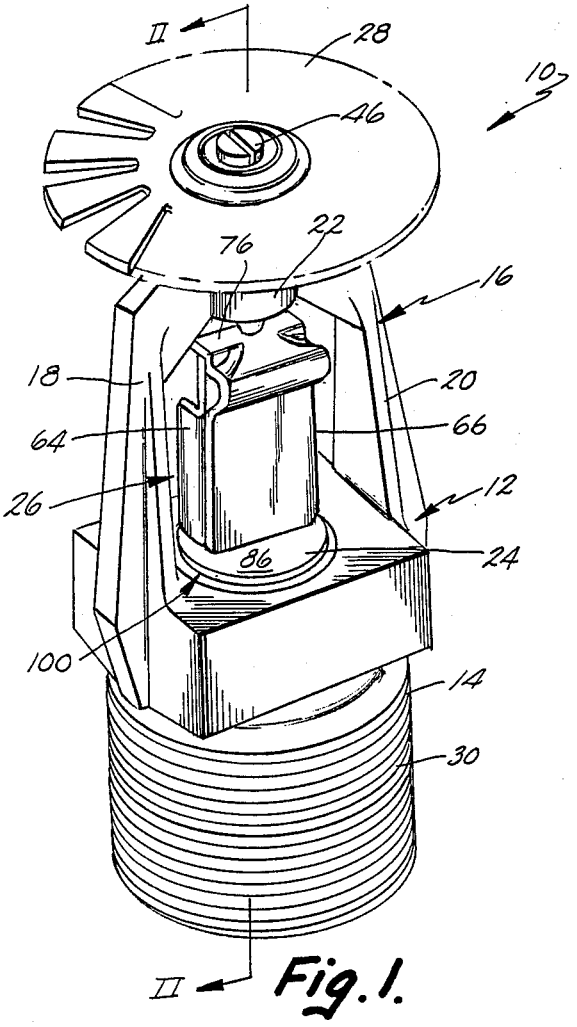
FIG. 1 is a perspective view of a sprinkler head in accordance with the present invention.

A preferred embodiment of the unique sprinkler head in accordance with the present invention is illustrated in the drawing and generally designated 10. As seen in FIG. 1, sprinkler head 10 includes a body 12 defining a nozzle 14 and a frame 16. Frame 16 extends from nozzle 14 and includes a pair of spaced arms 18, 20. Arms 18, 20 are joined opposite the nozzle at a portion designated 22. A closure plug, cap or valve element 24 is supported on the nozzle. A mechanical, rigid, fusible link or trigger assembly 26 is positioned between cap 24 and frame portion 22. A deflector 28 is supported concentrically with and opposite nozzle 14 on the arms 18, 20 of frame 16. Nozzle 14 includes external threads 30 by which the automatic sprinkler head is connected to the sprinkler system piping in a conventional fashion.

Figure 2:
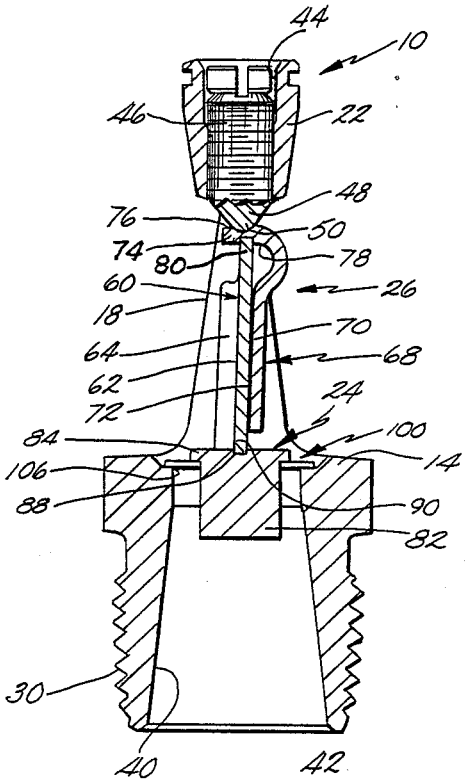
FIG. 2 is a cross-sectional view taken generally along line II—II of FIG. 1.

As best seen in FIG. 2, nozzle 14 defines an orifice or throughbore 40 having a central axis 42. Frame portion 22 directly opposite orifice 40 defines a bore 44. A pivot defining member 46 is adjustably disposed within bore 44. Bore 44 is internally threaded and member 46 is externally threaded. Member 46 at an end 48 defines a generally conical pivot 50. While the central axis of bore 44 is coincident with central axis 42 of the nozzle orifice, the pivot 50 is offset slightly from the central axis of nozzle 42.

The thermally responsive assembly 26, as illustrated, includes a first generally channel-shaped member 60 having a planar portion 62 and lateral side portions 64, 66. Positioned in opposed relationship to first member 60 is a second rigid, metal member 68. Member 68 likewise includes a flat or planar portion 70. Members 60, 68 are adjoined together by a fusible, temperature responsive material 72 which is preferably a eutectic solder. Member 68, as seen in FIG. 2, is generally L-shaped in vertical cross section and includes a leg portion 74 having an upper surface 76 which contacts pivot 50. A lower surface 78 of leg 74 is contacted by an upper end 80 of member 62. The link assembly is designed so that the fusible material 72 will fuse upon attainment of a predetermined ambient temperature. When material 72 fuses, the links or members 60, 68 separate from each other.

As best seen in FIG. 2, cap or closure plug 24 includes a generally cylindrical portion 82 which is disposed within the orifice defined by the nozzle and a peripheral end flange portion 84. Cap 24 includes an upper surface 86 which faces pivot point 50 and through which a recess 88 opens. A lower end 90 of fusible link member 62 is seated within recess 88.

Figure 3:
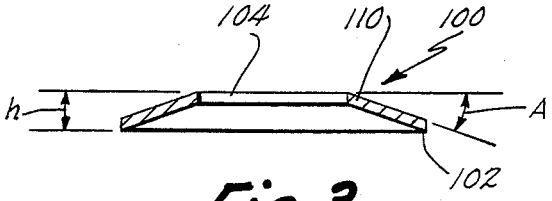
FIG. 3 is a cross-sectional view of a resilient means incorporated in the present invention.

In accordance with the present invention, cap 24 is supported on nozzle 14 by resilient means generally designated 100. As best seen in FIGS. 2 and 3, resilient means 100 is preferably a disc-like element of annular configuration and which is generally conical in vertical section when in a relaxed state. Resilient means 100 includes a peripheral edge portion 102 and a central aperture 104. As seen in FIG. 2, peripheral edge portion 102 engages and is supported on a shoulder or ledge 106 defined by nozzle 14. Cylindrical portion 82 of cap 24 is dimensioned to extend through aperture 104 defined in the resilient means 100. Peripheral flange 84 of cap 24 engages an inner peripheral portion 110 of the resilient means 100.

As seen in FIG. 3, means 100 is a conically-shaped, washer-like or disc-like spring when in a relaxed or uncompressed state. It is presently preferred that the disc-like member 100 be fabricated from a beryllium nickel alloy such as a Berylco brand Beryllium Nickel Alloy 440, one-half hard Spec. No. 036940-M. After fabrication, the disc-like member is heat treated for one and one-half hours at a temperature of 925° F. It is preferred that the resilient means 100 when being compressed from its conical, relaxed state towards a flattened state have a compression rate within the range of 85 to 100 lbs. per inch at an overall height of approximately 0.021 inches and that the means 100 have a 60 lb. per inch minimum compression rate at an overall height of approximately 0.034 inches.

A spring or resilient means 100 of the type illustrated in FIG. 3, therefore, has a nonlinear load-deflection curve. The nonlinear load curve having the preferred ranges set forth above provides an extremely wide range of latitude during assembly of the sprinkler head. This, therefore, increases reliability of the head and decreases costs associated with manufacture and assembly of the head when compared with prior heads employing the spring pressure or force which can be generated in the arms of the frame. In the head in accordance with the present invention, the arms are essentially unstressed in that the resilient means 100 creates the force necessary to throw out the link assembly 26 independent of any force which may be created by the arm assembly.

In a presently existing embodiment of the head in accordance with the present invention, the resilient means or disc-like member 100 in an unstressed or relaxed state as illustrated in FIG. 3 has an overall diameter of approximately 0.50 inches, an overall, relaxed height of approximately 0.040 inches. The annular or main body portion of member 100 assumes an angle designated A in FIG. 3 of approximately 12°. Member 100 has a thickness of approximately 0.0175 inches plus or minus 0.005 inches. The central aperture 104 has a diameter of approximately 0.264 inches. It is preferred for proper operation that all edges of resilient means 100 be free of burrs.

OPERATION

The sprinkler head in accordance with the present invention is assembled by placing cap 24 within aperture 104 of resilient means or spring 100. Spring 100 is then positioned on shoulder 106 of nozzle 14. The fusible link assembly 26 is placed into engagement with the upper surface of the cap and adjustable member 46 is turned within bore 44 to compress resilient means 100. When the predetermined temperature range is reached, material 72 will fuse and resilient means 100 will throw members 60, 68 out and away from the sprinkler head. Resilient means 100, since it is positioned with its initially conically-shaped side opening into orifice 40 and compressed towards a flattened configuration, creates a force biasing link assembly 26 into engagement with pivot point or pivot 50. The force created by resilient means 100 is sufficient in and of itself and independent of any force generated by the arms of the frame to throw the links free of the head. Water pressure within nozzle 14 throws cap 24 in the spring free of the head after fusing of material 72.

Since the frame is no longer relied upon to create the throw out force, criticality in manufacture of the frame and assembly of the head is eliminated. A relatively simple and less expensive fusible link assembly when compared with other structures may be employed without concern over proper throw out of these elements. Since the spring element or resilient means 100 has a nonlinear load curve, assembly is simplified.

In view of the foregoing description, those of ordinary skill in the art will undoubtedly envision various modifications which would not depart from the inventive concepts disclosed herein. For example, a mechanical link other than that illustrated could be employed while obtaining the benefits of the invention. Therefore, it is expressly intended that the above description should be considered as that of the preferred embodiment. The true spirit and scope of the invention may be determined by reference to the appended claims.

The embodiments of the invention in which an exclusive property or privilege is claimed are defined as follows:

1. A sprinkler head including a body defining a nozzle, a pair of arms extending upwardly from the nozzle and being joined opposite said nozzle, said arms defining a pivot point opposite said nozzle and which pivot point is offset from a central axis of said nozzle, a cap disposed within said nozzle, a fusible mechanical link means extending between said cap and said pivot point, said link means including a pair of rigid members held together by a temperature responsive and fusible material, one of said rigid members engaging said pivot point and the other of said rigid members engaging said cap, wherein the improvement comprises: resilient means disposed between said body and said cap for creating a force which will throw said link means away from said sprinkler head when a predetermined temperature range is reached at which the temperature responsive material fuses and permits said rigid members to separate and wherein said arms are essentially unstressed so as not to create a spring force capable of throwing said cap and said link means out and away from said nozzle, said resilient means being an annular-shaped, resilient, concave, disc-like member having a peripheral edge engaging said body at said nozzle and a central aperture within which said cap is disposed, each of said members of said pair of rigid members of said link means being generally flat, said rigid members being positioned against each other with said temperature responsive material sandwiched therebetween, said concave, disc-lik member having a compression rate within the range of 85 pounds per inch to 100 pounds per inch at an overall compressed height of 0.021 inches, and said concave, disc-like member having a minimum compression rate of 60 pounds per inch at an overall compressed height of 0.034 inches and a nonlinear load curve to permit thereby a wide range of latitude during assembly of the head without an adverse effect on operation.

* * * * *